United States Patent [19]

Hermant et al.

[11] Patent Number: 4,584,116

[45] Date of Patent: Apr. 22, 1986

[54] LUBRICANT COMPOSITIONS CONTAINING CALCIUM AND BARIUM FLUORIDES

[75] Inventors: Marc Hermant, Cormeilles en Parisis; Dominique Basset, Poissy; Jean-Claude Razet, Levallois Perret, all of France

[73] Assignee: Atochem, France

[21] Appl. No.: 637,039

[22] Filed: Aug. 2, 1984

[30] Foreign Application Priority Data

Aug. 31, 1984 [FR] France.....8313953

[51] Int. Cl.[4] ..... C10M 125/18; C10M 133/06

[52] U.S. Cl. ..... 252/51; 252/25; 252/58

[58] Field of Search ..... 252/25, 51, 58

[56] References Cited

U.S. PATENT DOCUMENTS

| | | | |
|---|---|---|---|
| 3,227,761 | 1/1966 | Brunner et al. | 252/51 |
| 3,453,209 | 1/1969 | Sibert | 252/25 |
| 3,775,318 | 11/1973 | Lavik et al. | 252/25 |
| 4,132,656 | 1/1979 | DeVries et al. | 252/30 |
| 4,134,844 | 1/1979 | DeVries et al. | 252/30 |
| 4,136,040 | 1/1979 | DeVries et al. | 252/30 |

FOREIGN PATENT DOCUMENTS

| | | |
|---|---|---|
| 2445078 | 11/1980 | France . |
| 2520377 | 7/1983 | France . |

OTHER PUBLICATIONS

*Russian Engineering Journal*, vol. 51, No. 2, 1971, A. S. Volkov, "Solid Inhibitors Prolong Life of Diesel Lubricating Oil", pp. 36–38.

*Primary Examiner*—Jacqueline V. Howard
*Attorney, Agent, or Firm*—Sigalos & Levine

[57] ABSTRACT

A lubricant composition comprising a lubricating oil having dispersed therein particles of lithium fluoride, calcium fluoride, and barium fluoride, or mixtures thereof.

4 Claims, No Drawings

LUBRICANT COMPOSITIONS CONTAINING CALCIUM AND BARIUM FLUORIDES

BACKGROUND OF THE INVENTION

The present invention concerns lubricant compositions containing particles of lithium, calcium and/or barium fluoride in the dispersed state.

It is known to disperse solid lubricants such as molybdenum bisulfide, graphite or its derivatives, or yet polytetrafluoroethylene in lubricating oil. These additives, however, present the drawback of not possessing very satisfactory thermal and chemical stability for good load carrying ability.

SUMMARY OF THE INVENTION

According to the invention, lubricating oils having a mineral or synthetic base are prepared with considerably increased load carrying ability.

Briefly, the present invention comprise a lubricant composition comprising an oil having dispersed therein particles of lithium, fluoride, calcium fluoride, barium fluoride, or mixtures thereof.

DETAILED DESCRIPTION

These fluoride particles are introduced by any known means into the basic oils. An especially recommended means consists of preparing a concentrated dispersion by mixing fluorides with lubricating oils for instance in a ball mill.

The oil used in the composition can be any oil conventionally used as a lubricating oil such as a mineral oil or a synthetic oil.

It is thus possible to obtain stable concentrated dispersions containing up to 50% by weight of fluoride in the oils, such as for instance oils refined with solvents of the type "100 Neutral" to "500 Neutral". Although they can be used as is, these concentrates can be diluted in oils preferably belonging to the same chemical family as that of the oil of the concentrate. These dilutions are a function of the subsequent utilization to be made of the lubricant composition. The concentrated or dilute dispersions can easily contain only fluoride particles of a size below 0.5 micron.

In order to stabilize the dispersion, it is recommended to add to the medium a dispersing agent whose definition and quantity are selected, in known manner, as a function of the oil. These dispersing agents are customarily selected from among calcium or barium alkylaryl sulfonates, calcium or barium alkylphenates(alkylphenolates) and polysuccinimides. By way of example, for the oils refined with solvents, it is preferred to use an additive without ash, of the polysuccinimide type as the dispersing agent.

The effect of the lubricant compositions is brought out in particular when the loads applied to the part in contact with or to the rubbing surface are mild or high. In these cases, one can observe a wear reduction as compared to standard lubricant compositions.

The properties of compositions based on synthetic oils like lubricant esters, the esters of carboxylic diacids and of mono-alcohols, the esters of neopentyl polyols and of carboxylic monoacids, the polyethers obtained by the fixation of alkylene oxides on compounds having mobile hydrogen atoms, and fluoride salts according to the invention are particularly advantageous.

Although the properties of lithium, calcium and barium fluorides are comparable, it has been observed that the dispersions in oils of mixtures of calcium and barium fluorides in the respective proportions by weight of 60 to 35 for 40 to 65 and particularly in the proportions of the eutectic mixture, i.e. 38% by weight of calcium fluoride and 62% by weight of barium fluoride, lead to more advantageous results than by using the calcium and barium fluorides alone.

The properties of the dispersions of the invention can advantageously be completed by combining with the lithium, calcium and/or barium fluorides an organic fluorinated additive; soluble in the oils, of the formula;

$$C_nF_{2n+1}(CHR_2)_x-\underset{\underset{R_1}{|}}{N}-A, \text{ or}$$

$$C_{n-1}F_{2n-1}-CF{=}CR_2-CHR_2-\underset{\underset{R_1}{|}}{N}-A$$

in which:

n is an integer from 2 to 20, $R_2$ is hydrogen or a lower alkyl radical comprising from 1 to 3 carbon atoms, x has the value of 2 or 4, $R_1$ and A respond to the following definitions:

(i) A is a hydrogen atom and $R_1$ is a hydrogen atom or an alkyl radical containing from 1 to 6 carbon atoms, an aryl radical or a cycloparaffin radical of 3 to 10 carbon atoms; or (ii) $R_1$ and A are identical or different alkyl radicals containing from 1 to 6 carbon atoms; or (iii) A is the group $$-CH_2-CH\begin{matrix}OH\\R\end{matrix},$$

While R1 is hydrogen, an alkyl radical containing from 1 to 6 carbon atoms, or the group $$CH_2-CH\begin{matrix}OH\\R\end{matrix};$$

R and $R^1$ being either a hydrogen atom or a methyl group $CH_3$, or (iv) $R_1$ and A together form a linear alkylene radical of 3 to 10 carbon atoms.

These organic fluorinated additives, described in French Patent Application 82,00964, can be introduced into the dispersion in the ratio of $$\frac{\text{organic fluorinated additive}}{\text{Li, Ca, and/or Ba fluoride}}$$

between about 1:5 and 1:100.

The compositions containing the two types of fluoride present properties of friction reduction and of wear reduction over a wide range of loads and temperature and lead to results superior to those obtained with traditional additives such as zinc alkyldithiophosphates.

The compositions of the invention find application in motors, hydraulic transmissions and other uses where lubricating oils are conventionally used.

The invention will be further described in connection with the following examples which are set forth for purposes of illustration only.

EXAMPLES 1 TO 8

The anti-wear ability and the load-carrying ability of the instant compositions are illustrated by a composition containing as the basic oil, the mineral oil "200 Neutral solvent" and as additives LiF, $CaF_2$, $BaF_2$, the eutectic mixture $CaF_2$-$BaF_2$ containing 38% by weight of $CaF_2$ and 62% by weight of $BaF_2$, are determined with the help of the 4-ball E.P. machine of Shell whose description appears in the "Annual Book of ASTM Standards", Part 24 (1979) pages 680 to 688.

The anti-wear test consists of applying a constant load of 70 da N for 1 hour and then of measuring the wear scar diameters on the three fixed balls.

The load-carrying ability test consists of measuring the diameters of the wear scar diameters as a function of the applied load. The results are expressed as Wear Load Index (W.L.I.) The operating conditions and the method of calculation of the W.L.I. are described in the ASTM 278371T method.

The results are listed in Table I.

The metallic fluoride dispersions are stabilized by the dispersing agent of the polysuccinimide type (OLOA 1200). Examples 1 and 3 are given as comparative examples.

Likewise mentioned in Table I are the values of the scuffing load and of the welding load which show that the metallic fluorides have an effect which is more marked at heavy loads than at low loads.

TABLE I

| Example No. | Compositions % by Weight | Scuffing Load (daN) | Welding Load (daN) | Wear Load Index (daN) | Wear Test 1 h at 70 daN Ø mm |
|---|---|---|---|---|---|
| 1 | 200 N = 0.5% OLOA 1200 | 63 | 160 | 22.7 | 2.32 |
| 2 | 200 N + 0.5% OLOA 1200 + 0.5% $CaF_2$ | 63 | 250 | 27.5 | 1.87 |
| 3 | 200 N + 1.5% OLOA 1200 | 63 | 160 | 28 | 2.3 |
| 4 | 200 N + 1.5% OLOA 1200 + 1.5% $CaF_2$ | 80 | 315 | 35.2 | 1.64 |
| 5 | 200 N + 1% OLOA 1200 + 1% $BaF_2$ | 63 | 250 | 28 | 1.81 |
| 6 | 200 N + 1.5% OLOA 1200 + 1.5% $BaF_2$ | 63 | 315 | 32.1 | 1.6 |
| 7 | 200 N + 1.5% OLOA 1200 + 1.5% LiF | 63 | 315 | 31 | 1.62 |
| 8 | 200 N + 1% OLOA 1200 + 1% of eutectic mixture $CaF_2$/BaF 38/62 | 80 | 400 | 38.9 | 1.67 |

EXAMPLES 9 TO 11

One prepares a dispersion of barium fluoride, and of the eutective calcium-barium mixture in a polyether (Emkarox FC 31-140) obtained by the fixation of a mixture of 75 parts by weight of ethylene oxide and 25 parts by weight of propylene oxide on trimethylolpropane and possessing a mean molecular weight of 1500. The compositions and the results according to ASTM standard 278371 T are listed in Table II.

Example 9 is given by way of comparison.

TABLE II

| Example No. | Compositions | Scuffing Load (daN) | Welding Load (daN) | Wear Load Index (daN) | Wear Test 1 h at 70 daN Ø mm |
|---|---|---|---|---|---|
| 9 | Emkarox FC 31-140 | 126 | 200 | 45.2 | 0.55 |
| 10 | Emkarox FC 31-140 + 1% $BaF_2$ | 160 | 315 | 60 | 0.42 |
| 11 | Emkarox FC 31-140 +1% of eutectic mixture $CaF_2$/$BaF_2$ 68/32 | 100 | 400 | 62 | 0.56 |

EXAMPLES 12 TO 15

The object of the tests described below is to bring out the formation of tribochemical films with the dispersions of fluorides in the oils, as well as the better thermal durability of the films obtained as compared to tribochemical films formed from zinc alkyldithiophosphates.

The tests comprise two stages:

First: Obtaining tribochemical films from compositions based on fluorides or zinc dithiophosphates in oil of the type "200 Neutral" on a plane-plane friction simulator under the following conditions:

| | |
|---|---|
| Ring | AISI 52100 steel |
| Plane surface | GL cast iron |
| Load | 50 da N |
| Temperature | 80° C. |
| Number of revolutions | 5000 |
| Sliding velocity | linear, between 40 and 60 $mms^{-1}$ |

The scheme of the principle of the tribometer having a plane-plane contact geometry appears in WEAR 53 (1979) page 10.

Second: The rings are rinsed with hexane after the tests, then dried, and the dry friction tests are carried out on the films formed on the rings, on a sphere-plane friction simulator, under the following conditions:

| | |
|---|---|
| Ring | AISI 52100 steel |
| Sphere | AISI 52100 steel |
| Load | 0.1 da N |
| Sliding velodity | 1 mm $s^{-1}$ |
| Sliding length | 2 mm |
| Temperature | linear elevation of the |

-continued

| | |
|---|---|
| | temperature at a velocity of 10° C. $mm^{-1}$ until rupture of the tribochemical film. |

The scheme of the principle of the tribometer having a sphere-plane contact geometry appears in WEAR, 53 (1979), page 10.

Table III presents the results obtained (friction coefficients, temperatures of failure of the films) on one hand with the compositions containing the fluorides and on the other hand with a composition containing a zinc dialkyldithiophosphate (Lubrizol 1395).

The calcium and barium fluorides form tribochemical films, which are friction reducers, with better thermal durability than the film formed from zinc dialkyldithiophoshate. Under the operating conditions adopted, with the fluorides one gains 70° to 80° C. in thermal durability as compared to zinc dithiophosphate.

TABLE III

| Example No. | Film formed from: | Friction Coefficient | Film failure temperature (°C.) |
|---|---|---|---|
| 12 | 200 N + 1.5% OLOA 1200 | 0.65 | 20 |
| 13 | 200 N + 1.5% OLOA 1200 + 1.5% $BaF_2$ | 0.1-0.2 | 340 |
| 14 | 200 N + 1.5% OLOA 1200 + 1.5% $CaF_2$ | 0.1-0.15 | 330 |
| 15 | 200 N + 1.5% OLOA 1200 + 1% Lubrizol 1395 | 0.1-0.2 | 260 |

EXAMPLES 16 TO 21

This series of examples brings out the formation of reaction films with the dispersions of fluorides as well as their good thermal resistance under tribological conditions different from those of the preceding series.

The tests are carried out on a sphere-plane tribometer with a AISI 52100 steel sphere and GL cast iron plane. The load is 1 da N, the velocity is 1 mm s-1 for a sliding distance of 1 cm: one uses 0.1 ml of lubricant deposited in the contact and the temperature is raised by 20° C. mm-1.

For the compositions used, at 275° C., the oil has disappeared by evaporation and thermo-oxidizing decomposition but one continues dry friction while continuing to raise the temperature.

Table IV gives the results obtained with the compositions tested; that is to say, the film failure temperature and the value of the friction coefficient prior to rupture.

Comparative Example 16 shows that film which acts as friction reducer is not being formed, the indicated value of the friction coefficient is the one obtained prior to the disappearance of the lubricant; in dry friction it attains the value of 0.37 corresponding to the unlubricated friction of AISI 52100 steel on GL cast-iron.

TABLE IV

| Example No. | Film formed from | Friction Coefficient | Film failure Temperature (°C.) |
|---|---|---|---|
| 16 | 200 N + 1.5% OLOA 1200 | 0.08 | 275 |
| 17 | 200 N + 1.5% OLOA 1200 + 1% Lubrizol 1395 | 0.2 | 360 |
| 18 | 200 N + 1.5% OLOA 1200 + 1.5% $BaF_2$ | 0.25 | 380 |
| 19 | 200 N + 1.5% OLOA 1200 + 1.5% $CaF_2$ | 0.2 | 340 |
| 20 | 200 N + 1.5% OLOA 1200 + 1.5% eutectic mixture $CaF_2/BaF_2$ 38/62 | 0.25 | 420 |
| 21 | 200 N + 1.5% OLOA 1200 + 1.5% LiF | 0.12 | 420 |

EXAMPLES 22 AND 23

The following examples show the advantages that one derives from the combination of calcium fluorides or of calcium-barium fluorides with fluorinated organic anti-wear additives soluble in the lubricant bases. The amines and amino alcohols having fluorinated chains, which are remarkable anti-wear additives within the range of low and mild loads, contribute a complementary anti-wear effect, which makes it possible to obtain effective compositions within a wide range of temperatures and of loads.

The tests were carried out under the conditions previously described for Examples 1 to 8.

The compositions and the results obtained (according to ASTM Standard 2783-71 T) are given in Table V.

TABLE V

| Example No. | Composition | Scuffing Load daN | Welding Load daN | Wear Load Index daN | Wear Test 1 h at 70 daN ø mm |
|---|---|---|---|---|---|
| 22 | 200 N + 1.5% OLOA 1200 | 63 | 160 | 23 | 2.3 |
| | 200 N + 1.5% OLOA 1200 + 1.5% $CaF_2$ | 80 | 315 | 35.2 | 1.64 |
| | 200 N + 1.5% OLOA 1200 + 1.5% $CaF_2$ + 0.2% $C_8F_{17}C_2H_4NHC_2H_4OH$ | 160 | 315 | 47.2 | 0.91 |
| 23 | 200 N + 1% OLOA 1200 + 1% eutectic mixture $CaF_2/BaF_2$ 38/62 | 80 | 400 | 38.9 | 1.67 |
| | 200 N + 1% OLOA 1200 + 1% eutectic mixture $CaF_2/BaF_2$ 38/62 + 0.2% $C_8F_{17}C_2H_4NHC_2H_4OH$ | 160 | 400 | 62 | 0.51 |

EXAMPLES 24 TO 26

The results of these examples show that the dispersions of fluorides remain effective when they are combined with traditional additives entering into the composition of oils for internal combustion engines, such as pour point depressant additives, viscosity index improvers, antioxidants, and anti-corrosion agents. The antiwear properties and load-carrying ability were carried out with the 4-ball EP machines of Shell under conditions identical to those of the tests of Examples 1 to 8.

Listed in Table VI are the results obtained by dispersing in three oils containing all the standard additives, without the anti-wear zinc dialkyldithiophosphates, e.i. 1% by weight of $BaF_2$ or of $CaF_2$-$BaF_2$ mixture in the proportions of the eutectic mixture containing 38% by weight of $CaF_2$ and 62% by weight of $BaF_2$.

These three compositions, without zinc dialkyldithiophosphates, correspond respectively to:

a standard SAE 15 W 40 oil for gasoline engines;
a SAE 15 W 30 oil of semi-synthetic base (mixture of trimethylolpropane ester and poly α olefins) for gasoline engines;
a SAE 15 W 30 oil for diesel engines.

The principal additives of these oils are polymethacrylates as pour point depressants and viscosity index improvers, polysuccinimides as dispersing agents, and calcium alkylarylsulfonates as detergents.

The diesel oil presents the particularity of containing as dispersing agents—detergents at the same time a calcium phenolate, a calcium sulfonate, and a polysuccinimide.

TABLE VI

| Example No. | Composition | Scuffing Load daN | Welding Load daN | Wear Load Index daN | Wear Test 1 h at 70 daN Ø mm |
|---|---|---|---|---|---|
| 24 | 15 W 40 gasoline engine oil | 80 | 250 | 30.4 | 1.19 |
| | 15 W 40 gasoline engine oil + 1% $CaF_2$/$BaF_2$ 36/62 | 80 | 315 | 37 | 0.9 |
| 25 | 10 W 30 semi-synthetic | 80 | 250 | 32.2 | 1.45 |
| | 10 W 30 semi-synthetic + 1% $BaF_2$ | 1100 | 315 | 43.3 | 1.1 |
| 26 | 10 W 30 Diesel | 80 | 315 | 36.7 | 1.77 |
| | 10 W 30 Diesel + 1% eutetic mixture $CaF_2$/$BaF_2$ 36/62 | 100 | 400 | 47.1 | 1.6 |

While the invention has been described in connection with a preferred embodiment, it is not intended to limit the scope of the invention to particular form set forth, but on the contrary, it is intended to cover such alternatives, modifications, and equivalents as may be included within the spirit and scope of the invention as defined by the appended claims.

What is claimed is:

1. A lubricant composition consisting essentially of a lubricating oil having dispersed therein a mixture of calcium fluoride and barium fluoride having a particle size below about 0.5 micron; said mixture containing for each 100 parts by weight thereof 60 to 35 parts calcium fluoride and, correspondingly, 40 to 65 parts barium fluoride.

2. The lubricant composition of claim 1 wherein said oil is selected from a mineral oil or synthetic oil and the composition contains an amount up to 50% by weight of said particles.

3. The lubricant composition of claim 2 also containing an organic fluorinate compound soluble in said oil and having the formula $$C_nF_{2n+1}(CHR_2)_x-\underset{\underset{R_1}{|}}{N}-A \text{ or}$$

$$C_{n-1}F_{2n-1}CF{=}CR_2CHR_2-\underset{\underset{R_1}{|}}{N}-A$$

wherein n is an integer from 2 to 20, $R_2$ is hydrogen or a lower alkyl radical containing from 1 to 3 carbon atoms, x has the value of 2 or 4, $R_1$ and A are one of the following:

A is a hydrogen atom and $R_1$ is a hydrogen atom, alkyl radical containing from 1 to 6 carbon atoms, an aryl radical or a cycloparaffin radical having 3 to 10 carbon atoms; or $R_1$ and A are identical or different alkyl radicals containing from 1 to 6 carbon atoms; or A is the group $$-CH_2-CH\begin{matrix}\diagup OH\\ \diagdown R^1\end{matrix},$$

while $R_1$ is hydrogen, or an alkyl radical containing from 1 to 6 carbon atoms or the group $$CH_2-CH\begin{matrix}\diagup OH\\ \diagdown R^1\end{matrix},$$

R and $R^1$ being either a hydrogen atom or the methyl group $CH_3$; or $R_1$ and A together form a linear alkylene radical having 3 to 10 carbon atoms.

4. The lubricant composition of claim 3, wherein the ratio of $$\frac{\text{organic fluorinated additive}}{\text{Ca and Ba fluoride}}$$

is between about 1:5 and 1:100.

* * * * *